US011938409B2

(12) United States Patent
Goedeker et al.

(10) Patent No.: US 11,938,409 B2
(45) Date of Patent: Mar. 26, 2024

(54) BALL BALANCE GAME AND METHOD OF PLAYING

(71) Applicant: Wild Ideas Designs, LLC, Parker, CO (US)

(72) Inventors: Hayden Goedeker, Parker, CO (US); William Van Orman, Parker, CO (US)

(73) Assignee: Wild Ideas Designs, LLC, Parker, CO (US)

( * ) Notice: Subject to any disclaimer, the term of this patent is extended or adjusted under 35 U.S.C. 154(b) by 259 days.

(21) Appl. No.: 17/358,289

(22) Filed: Jun. 25, 2021

(65) Prior Publication Data

US 2022/0409990 A1 Dec. 29, 2022

(51) Int. Cl.
*A63F 9/26* (2006.01)

(52) U.S. Cl.
CPC ..... *A63F 9/26* (2013.01)

(58) Field of Classification Search
CPC ... A63F 9/26; A63F 9/02; A63B 63/00; A63B 2069/0077
See application file for complete search history.

(56) References Cited

U.S. PATENT DOCUMENTS 1,530,573 A * 3/1925 Olcott ..... A63B 60/02 124/5
3,202,424 A * 8/1965 Patterson ..... A63F 9/26 D21/399
4,039,186 A * 8/1977 Anderson ..... A63B 67/22 273/444
4,113,253 A * 9/1978 Huston ..... A63B 67/083 482/44
5,735,050 A * 4/1998 Hsieh ..... A47G 21/04 30/322
6,032,822 A * 3/2000 Munari ..... A47J 43/287 220/573.1
6,688,469 B1 * 2/2004 Barnes ..... B65D 77/245 206/217
10,322,335 B1 * 6/2019 Krieman ..... A63F 7/34
2005/0081385 A1 * 4/2005 Ho ..... A47J 43/281 30/325

(Continued)

FOREIGN PATENT DOCUMENTS

CN 101146579 A * 3/2008 ..... A63B 59/20
DE 29905556 U1 * 6/1999 ..... A63F 9/26
KR 20210096536 A * 8/2021 ..... A63B 59/20

OTHER PUBLICATIONS

Egg and spoon race [online]. kidspot, 2015. [retrieved on May 5, 2023]. Retrieved from the Internet: <URL:https://www.kidspot.com.au/parenting/things-to-do/egg-and-spoon-race/news-story/83219043770d6818271e695235c915d8>. (Year: 2015).*

(Continued)

*Primary Examiner* — Raleigh W Chiu
(74) *Attorney, Agent, or Firm* — Hall Estill Law Firm

(57) ABSTRACT

A game apparatus includes at least two balls and two balance apparatuses for balancing the balls thereon. Each balance apparatus can be held by a separate player. A method of playing a ball balance game includes equipping at least two players each with a balance apparatus and a ball. Each ball is balanced on each balance apparatus. Players can then be positioned at desired locations relative to each other. A desired game can then be started with the balls and the balance apparatuses.

20 Claims, 5 Drawing Sheets

(56) References Cited

U.S. PATENT DOCUMENTS

| | | | | |
|---|---|---|---|---|
| 2007/0010359 | A1* | 1/2007 | Arrington | A63B 19/02 D21/811 |
| 2015/0330781 | A1* | 11/2015 | Harris | A47G 21/02 7/164 |
| 2017/0197136 | A1* | 7/2017 | Maloney | A63B 71/0619 |
| 2022/0409990 | A1* | 12/2022 | Goedeker | A63F 9/26 |

OTHER PUBLICATIONS

How to Have an Egg Race [online]. wikiHow, 2021. [retrieved on May 5, 2023]. Retrieved from the Internet: <URL: https://www.wikihow.com/Have-an-Egg-Race>. (Year: 2021).*

Stacy Westfall Egg and Spoon Balance Training Tool [online], 2014. [retrieved on May 6, 2023]. https://www.statelinetack.com/item/stacy-westfall-egg-and-spoon-balance-training-tool/E003972/?srccode=PJSLT&utm_source=affiliate&utm_medium=referral&source=pepperjam&publisherId=159404&clickId=4374370216 (Year: 2014).*

* cited by examiner

BALL BALANCE GAME AND METHOD OF PLAYING

STATEMENT REGARDING FEDERALLY SPONSORED RESEARCH OR DEVELOPMENT

Not applicable.

CROSS-REFERENCE TO RELATED APPLICATIONS

Not Applicable.

BACKGROUND OF THE DISCLOSURE

1. Field of the Invention

The present disclosure relates to a ball balance game and method playing the same.

2. Description of the Related Art

Games of various types have been around for many years. Some games use cards or boards of varying types. Some games are designed to be played outside with a ball of some type. There are games of skill, games of chance, games of balance, etc. People are consumers and participants of a lot of different types of games.

Accordingly, there is likely a desire for a ball balance game and method of playing the same.

SUMMARY OF THE DISCLOSURE

The present disclosure is directed to a game apparatus. The game apparatus includes at least two balls and two balance apparatuses for balancing the balls thereon. Each balance apparatus can be held by a separate player.

The present disclosure is directed to a method of playing a ball balance game. The method includes equipping at least two players each with a balance apparatus and a ball. Each ball is balanced on each balance apparatus. Players can then be positioned at desired locations relative to each other. A desired game can then be started with the balls and the balance apparatuses.

DETAILED DESCRIPTION OF THE DISCLOSURE

Figure 1A:
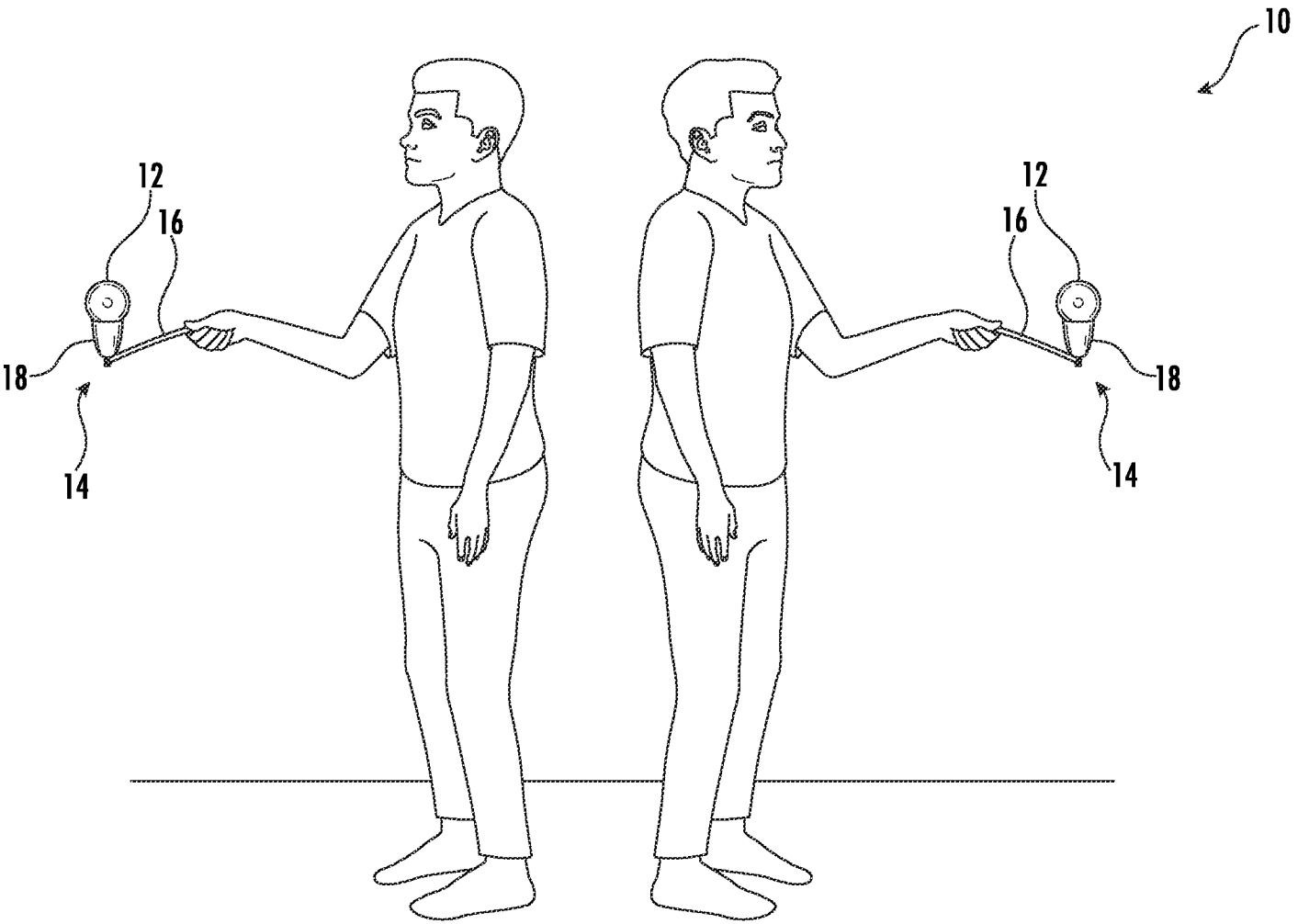
FIG. 1A is a side elevation view of players in a first position using a ball balance game constructed in accordance with the present disclosure.
Figure 1B:
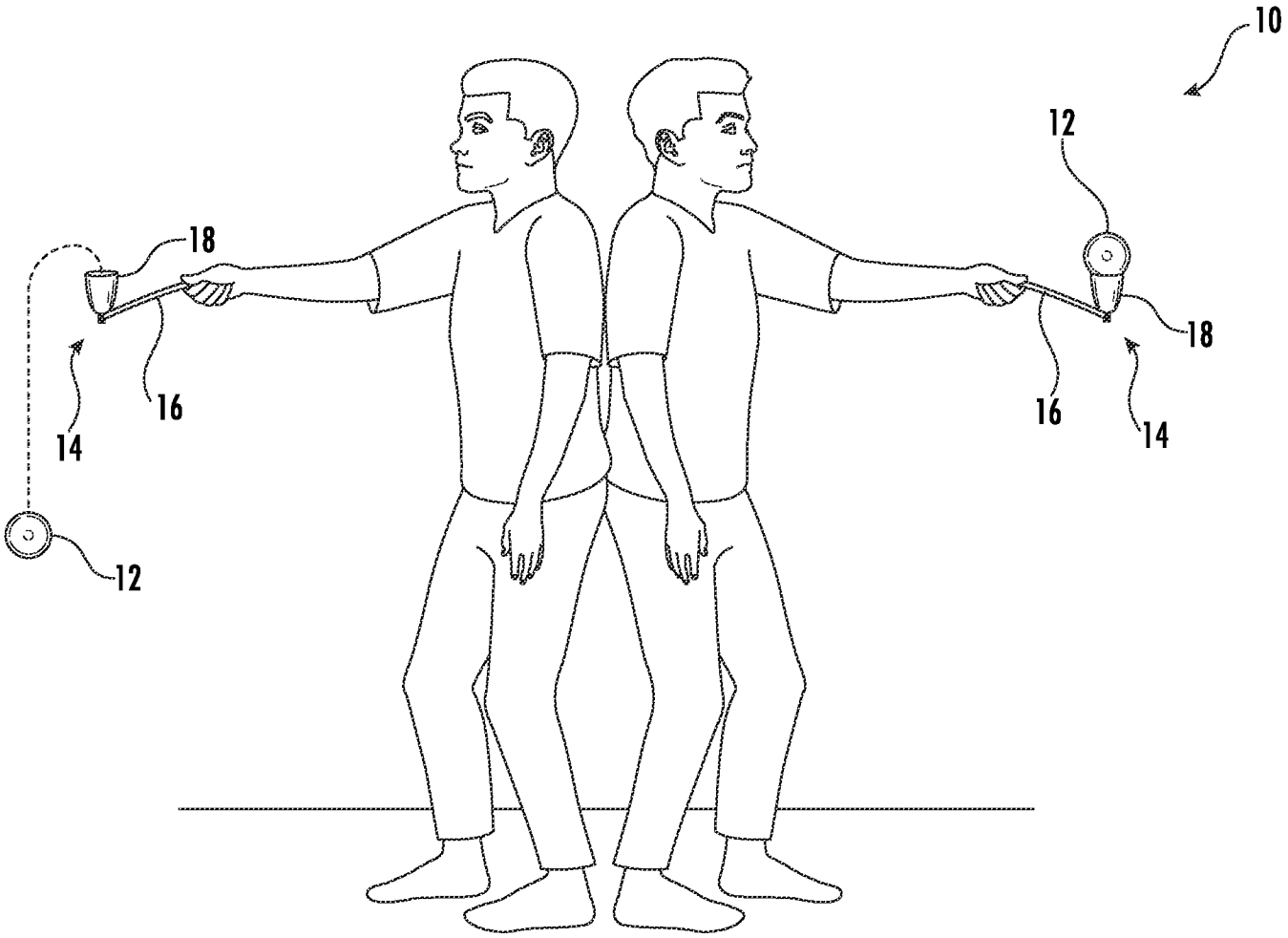
FIG. 1B is a side elevation view of players in a second position using the ball balance game constructed in accordance with the present disclosure.
Figure 2:
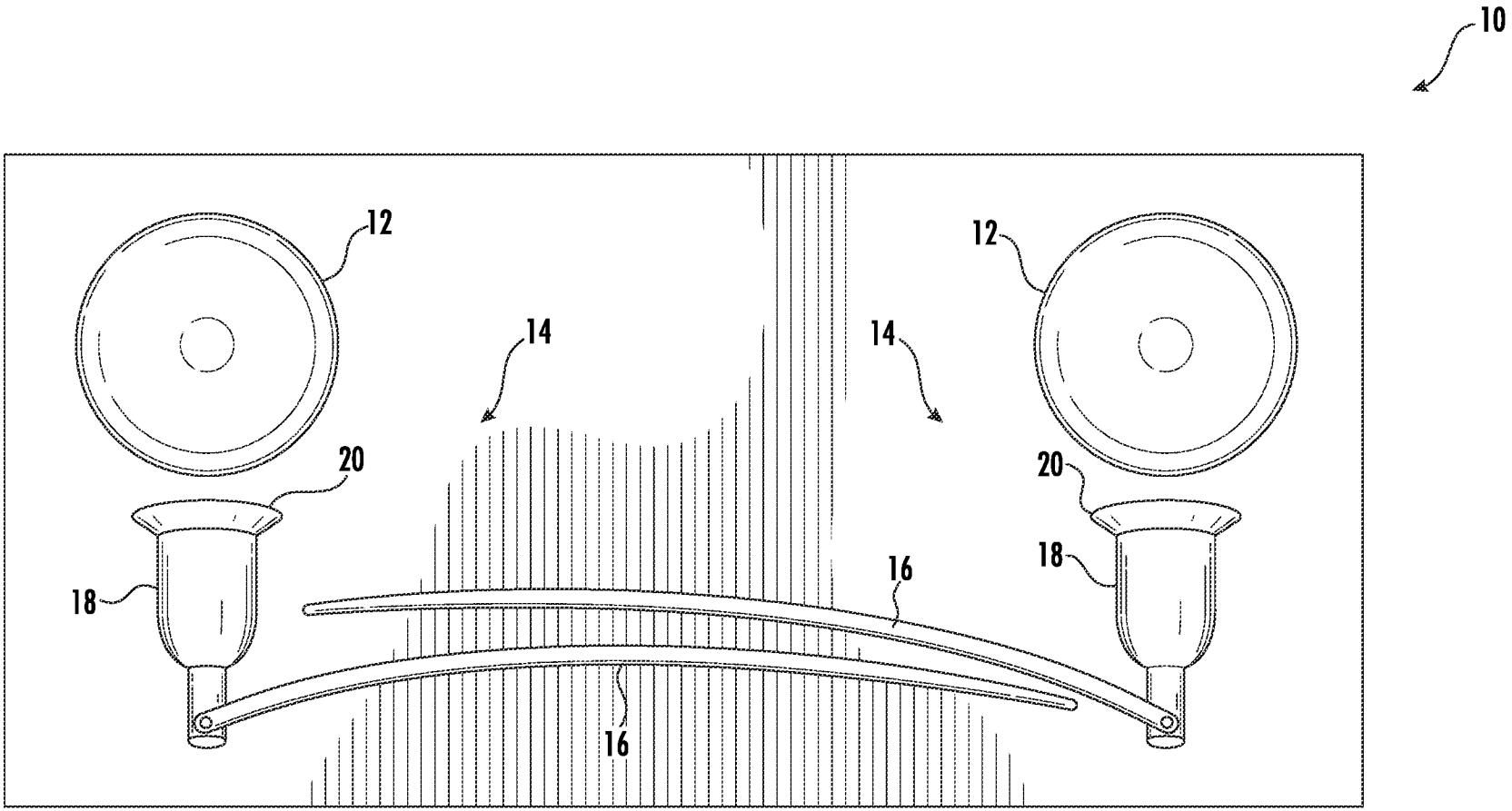
FIG. 2 is a side elevation view of the ball balance game constructed in accordance with the present disclosure.
Figure 3A:
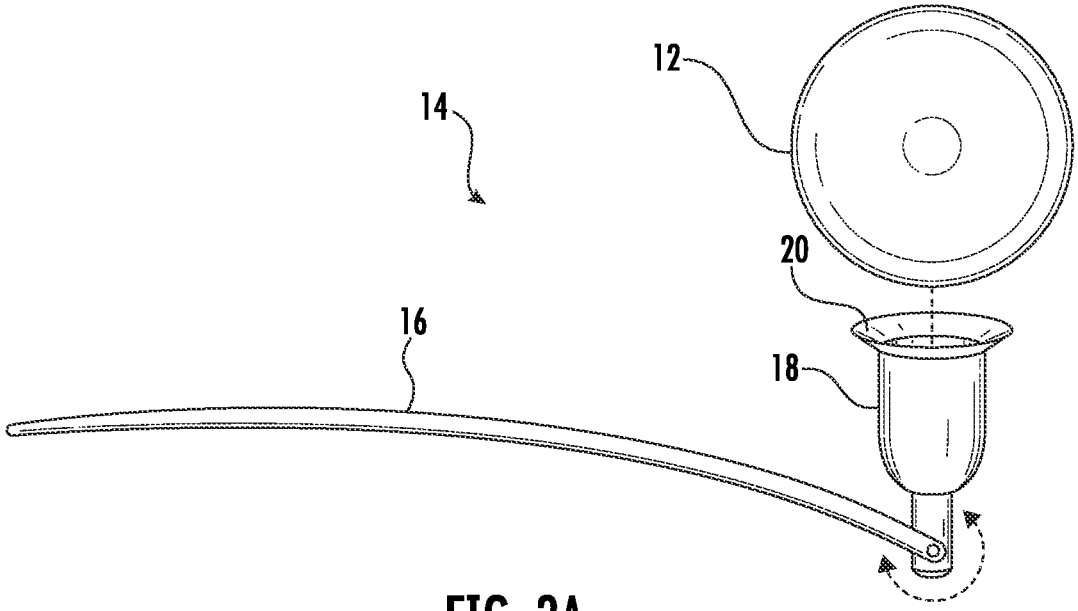
FIGS. 3A-3B are side elevation views of various embodiments of ball balance apparatuses constructed in accordance with the present disclosure.
Figure 3B:
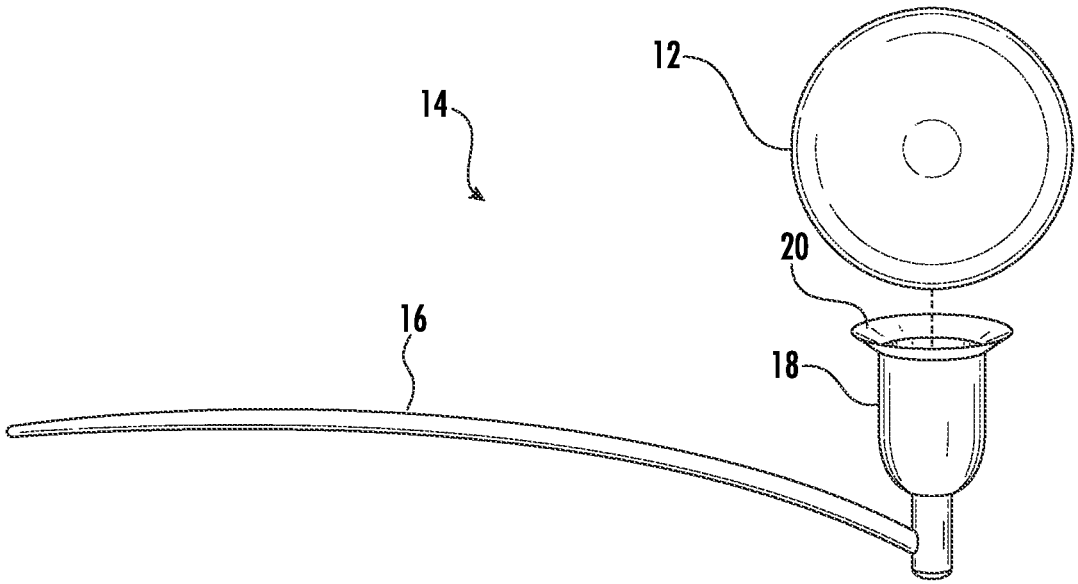
Figure 4A:
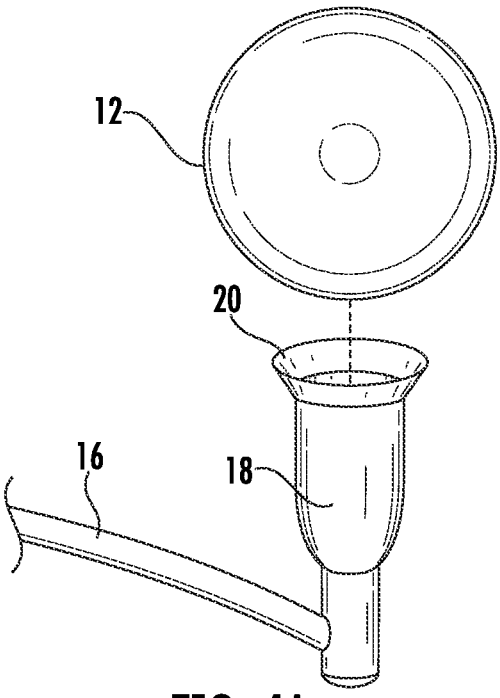
FIGS. 4A-4B are side elevation views of further embodiments of the ball balance apparatuses constructed in accordance with the present disclosure.
Figure 4B:
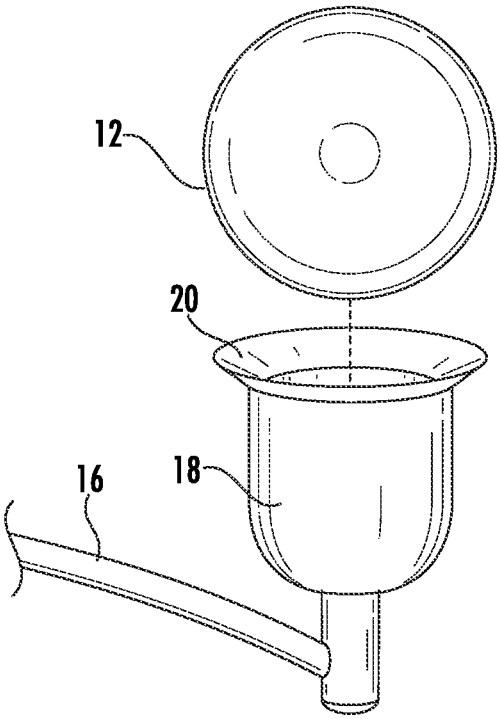

Referring now to FIGS. 1A-4B, shown therein is a ball balance game 10 and method playing the same. The ball balance game 10 includes at least two balls 12 and two balance apparatuses 14 for use by players to balance the balls 12. A balance apparatus 14 includes a rigid handle 16 and a cup portion 18 supported on one end of the handle 16 for having a ball 12 balanced thereon. The cup portion 18 can be statically attached to the handle 16 wherein the cup portion 18 cannot move relative to the handle 16. In one embodiment, the cup portion 18 is positioned substantially perpendicular to the length of the handle of the balance apparatus 14. In another embodiment, the cup portion 18 can be rotatably supported by the handle 16 so that the cup portion 18 can rotate from one side of the handle 16 to the other. The handle 16 can be any shape and size to increase or decrease the difficulty of the game. For example, the handle 18 can be curved or bent in an upward or downward orientation so that the cup portion 18 is above or below the hand of the player.

The cup portion 18 can be any size and shape such that it has a rim 20 that is capable of having a ball 12 balanced thereon. The cup portion 18 can be conically shaped, the cup portion 18 can be open bottomed, etc. The rim 20 of the balance apparatus 14 and the balls 12 can be sized and shaped such that the ball 12 will remain on the rim 20 unless there is some disruption to the balance apparatus 14. The size of the ball 12 can be related to the size of the rim 20 or the size of the rim 20 can be related to the size of the ball 12. The smaller the diameter of the rim 20 is relative to the diameter of the ball 12, the easier the ball 12 would fall off of the balance apparatus 14. Conversely, the larger the diameter of the rim 20 is relative to the diameter of the ball 12, the harder it would be for the ball 12 to fall from the balance apparatus 14.

In one embodiment, the radius or diameter of the rim 20 can be between 15 percent of the radius or diameter of the ball 12 to 90 percent of the radius or diameter of the ball 12. In another embodiment, the radius or diameter of the rim 20 can be between 25 percent of the radius or diameter of the ball 12 to 85 percent of the radius or diameter of the ball 12. In a further embodiment, the radius or diameter of the rim 20 can be between 35 percent of the radius or diameter of the ball 12 to 80 percent of the radius or diameter of the ball 12. In an even further embodiment, the radius or diameter of the rim 20 can be between 45 percent of the radius or diameter of the ball 12 to 75 percent of the radius or diameter of the ball 12. In yet another embodiment, the radius or diameter of the rim 20 can be between 55 percent of the radius or diameter of the ball 12 to 70 percent of the radius or diameter of the ball 12.

In further embodiments, the radius or diameter of the rim 20 can be less than 70 percent of the radius or diameter of the ball 12, less than 60 percent of the radius or diameter of the ball 12, less than 50 percent of the radius or diameter of the ball 12, less than 40 percent of the radius or diameter of the ball 12, or less than 30 percent of the radius or diameter of the ball 12. Conversely, the radius or diameter of the rim 20 can be greater than 50 percent of the radius or diameter of the ball 12, greater than 60 percent of the radius or diameter of the ball 12, greater than 70 percent of the radius or diameter of the ball 12, greater than 80 percent of the radius or diameter of the ball 12, or greater than 90 percent of the radius or diameter of the ball 12.

There are several ways to play the ball balance game 10. In use, at least two players will each have a balance apparatus 14 and a ball 12. The balls 12 are then placed on each player's balance apparatus 14 and each player will hold the balance apparatus 14 in one hand. Players can then stand back to back and the game, or a round in a game, can start.

In one embodiment, each player can take one step forward before the game, or the round, can start. Once the game starts, players try to get the other player (or players) to drop their ball 12 off of their balance apparatus 14. The first player's ball 12 to drop loses that round and can be assigned a first letter of a word being spelled to signal when a player has lost the game. For example, the first player to lose 5 rounds loses the game and gets a letter for each round lost to spell a predetermined word, such as L-O-S-E-R. In one embodiment, a player only wins a round/game if the other player's ball 12 drops and they maintain the balance of their ball 12.

The game can have limitations on what each player can do to the other during a game. For example, it could prohibit punching, kicking, head strikes, touching of another player's balance apparatus 14, no throwing objects at the other player, etc. In one alternate embodiment, the balls 12 can be glow in the dark so the game can be played in the dark, either outside or inside. The game can be set up where the balance apparatus 14 has to be held in each player's non-dominant hand. The game could have more than two players.

In further embodiments, the balance apparatus 14 can be used by the players in a race. Or, the players can place the ball 12 on the balance apparatus 14 and go and accomplish certain tasks, such as retrieving various items, maneuvering various obstacles, stepping over objects, ducking under objects, walking a straight line over a certain distance, and the like, while maintaining balance of the ball 12 on the balance apparatus 14.

In another embodiment, teams can be created from a certain number of players. The balance apparatus 14 and ball 12 can be used by the teams of players to do a relay race. Each player can cover a certain distance with their ball 12 balanced on the balance apparatus 14 and then they transfer the ball 12 to the next player's balance apparatus 14 without touching the ball 12. This can happen for any desired number of legs of the relay with any number of teams and number of players on each team.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A game apparatus, the game apparatus comprising:

two balls; and two balance apparatuses for balancing the balls thereon, the balance apparatuses holdable by two players, each balance apparatus includes a rigid handle and a cup portion rotatably attached to the handle, the cup portion free to rotate about the handle without being lockable in any position when the balance apparatuses are in use for their primary purpose.

2. The game apparatus of claim 1 further comprising three or more balls and three or more balance apparatuses to permit three or more players to play a game.

3. The game apparatus of claim 1 wherein each cup portion includes a rim where each ball is balanced thereon during the game, the rim has a diameter that is sized relative to a diameter of the balls to alter the difficulty of the game.

4. The game apparatus of claim 3 wherein the diameter of the rim is between 15 percent and 90 percent of the diameter of the balls.

5. The game apparatus of claim 3 wherein the diameter of the rim is between 45 percent and 75 percent of the diameter of the balls.

6. The game apparatus of claim 3 wherein the diameter of the rim is less than 60 percent of the diameter of the balls.

7. The game apparatus of claim 3 wherein the diameter of the rim is less than 40 percent of the diameter of the balls.

8. The game apparatus of claim 3 wherein the diameter of the rim is greater than 60 percent of the diameter of the balls.

9. The game apparatus of claim 3 wherein the diameter of the rim is greater than 80 percent of the diameter of the balls.

10. A method of playing a ball balance game, the method comprising:

equipping at least two players each with a balance apparatus and a ball, each balance apparatus includes a handle and a cup portion rotatably supported by the handle, the cup portion free to rotate about the handle without being lockable in any position when the balance apparatuses are in use for their primary purpose;

balancing each ball on each balance apparatus;

positioning the players at desired locations relative to each other; and beginning a desired game with the balance apparatuses and the balls.

11. The method of claim 10 wherein the desired game is determining which player's ball drops from their balance apparatus first.

12. The method of claim 10 wherein the desired game is conducting a race between the players with the ball balanced on the balance apparatuses.

13. The method of claim 10 wherein the desired game is timing a player through an obstacle course while the ball is balanced on the balance apparatus.

14. The method of claim 10 wherein the desired game is a relay race between teams of multiple players wherein the players of each team have to pass their ball from one player's balance apparatus to another player's balance apparatus for each player on the team.

15. The method of claim 10 wherein each cup portion includes a rim where each ball is balanced thereon during the game, the rim has a diameter that is sized relative to a diameter of the balls to alter the difficulty of the game.

16. The method of claim 15 wherein the diameter of the rim is between 15 percent and 90 percent of the diameter of the balls.

17. The method of claim 15 wherein the diameter of the rim is between 45 percent and 75 percent of the diameter of the balls.

18. The method of claim 15 wherein the diameter of the rim is less than 60 percent of the diameter of the balls.

19. The method of claim 15 wherein the diameter of the rim is less than 40 percent of the diameter of the balls.

20. The method of claim 15 wherein the diameter of the rim is greater than 80 percent of the diameter of the balls.

* * * * *